US006189508B1

(12) United States Patent
Stan

(10) Patent No.: US 6,189,508 B1
(45) Date of Patent: Feb. 20, 2001

(54) METHOD FOR FUEL INJECTION IN MULTICYLINDER ENGINES AND DEVICE FOR THE IMPLEMENTATION OF SAID METHOD

(75) Inventor: Cornel Stan, Aue (DE)

(73) Assignee: Forschungs- und Transferzentrum e.V. an der westsächsischen Hochschule Zwickau, Zwickau (DE)

( * ) Notice: Under 35 U.S.C. 154(b), the term of this patent shall be extended for 0 days.

(21) Appl. No.: 09/180,649

(22) PCT Filed: Mar. 9, 1998

(86) PCT No.: PCT/DE98/00716

§ 371 Date: Jan. 11, 1999

§ 102(e) Date: Jan. 11, 1999

(87) PCT Pub. No.: WO98/40658

PCT Pub. Date: Sep. 17, 1998

(30) Foreign Application Priority Data

Mar. 12, 1997 (DE) ..... 197 10 128
Apr. 12, 1997 (DE) ..... 197 15 355

(51) Int. Cl.[7] ..... F02M 15/00
(52) U.S. Cl. ..... 123/467; 123/541
(58) Field of Search ..... 123/41.31, 467, 123/541, 456

(56) References Cited

U.S. PATENT DOCUMENTS 3,945,353 * 3/1976 Dreisin ..... 123/41.31
4,539,959 * 9/1985 Williams ..... 123/456
4,860,700 * 8/1989 Smith ..... 123/41.31
5,156,134 * 10/1992 Tochizawa ..... 123/541
5,311,850 * 5/1994 Martin ..... 123/456
5,423,303 * 6/1995 Bennett ..... 123/456
5,584,279 * 12/1996 Bruiunhofer ..... 123/541
5,592,968 * 1/1997 Nakashima ..... 123/467
5,711,274 * 1/1998 Drummer ..... 123/467
5,713,326 * 2/1998 Huber ..... 123/467
5,752,486 * 5/1998 Nakashima ..... 123/456
5,852,997 * 12/1998 Vanderpoel ..... 123/456
5,860,394 * 1/1999 Saito ..... 123/41.31
5,887,555 * 3/1999 Schmitz ..... 123/541
5,893,350 * 4/1999 Timms ..... 123/467
5,913,300 * 6/1999 Drummond ..... 123/467
5,975,032 * 11/1999 Iwata ..... 123/541

FOREIGN PATENT DOCUMENTS 1 046 949 12/1958 (DE) .
196 39 149 2/1998 (DE) .

* cited by examiner

*Primary Examiner*—Carl S. Miller
(74) *Attorney, Agent, or Firm*—Collard & Roe, P.C.

(57) ABSTRACT

A method of injecting fuel in multicylinder engines. A fuel pre-pressure is generated to be converted within acceleration pipes by opening controlled shutoff valves and recirculating fuel to a fuel pump inlet. The fuel under pre-pressure is conveyed via a fuel pump into a pre-pressure common rail common to several engine cylinders. This pre-pressure is only a fraction of the required injection pressure. When the pre-pressure is exceeded, fuel is fed from the pre-pressure common rail, via pressure-limiting valves, into a return common rail common to several engine cylinders. The shutting off of the shutoff valves provokes a steep rise of fuel pressure, due to a water hammer effect. This produces a high-pressure wave since the closed shutoff valve supplies high pressure for fuel injection through the respective injection nozzle associated with the shutoff valve. One acceleration pipe is used for every shutoff valve between the pre-pressure common rail and the return common rail. At least one injection nozzle is actuated in the respective acceleration pipe per shutoff valve.

9 Claims, 1 Drawing Sheet

METHOD FOR FUEL INJECTION IN MULTICYLINDER ENGINES AND DEVICE FOR THE IMPLEMENTATION OF SAID METHOD

BACKGROUND OF THE INVENTION

1. Field of the Invention

The invention relates to a method of fuel injection in multicylinder engines. A fuel pre-pressure is generated in order to convey the fuel inside an inertia pipe via electromagnetically or mechanically controlled valves in the acceleration pipes. This occurs by recirculating the fuel to the reservoir via a return line, and subsequently shutting off the valve, in order to provoke a steep pressure rise by water hammer effect. Each injection nozzle associated with a shutoff valve is supplied with a high-pressure wave. The invention also pertains to a device for carrying out the method. Such technical solutions are required mainly for injecting fuel in internal combustion engines. Preferred fields of application are multicylinder gas engines with Diesel pilot injection, multicylinder compression ignition engines, multicylinder spark ignition engines, and multicylinder engines for the use of alternative fuels.

2. The Prior Art

Multicylinder engines are predominantly equipped with fuel pumps, which are driven by camshafts. The injection rate supplied to the operating cylinders has, in this connection, a marked dependence upon the engine speed with respect to droplet size and spray penetration length. On the other hand, in common rail systems, a constant fuel pressure at maximum value is always prevailing in the rail or overall system up to the injection nozzles. The maximum pressure, however, is only required temporarily during injection of the fuel due to the opening of one or a plurality of electromagnetically controlled injection nozzles.

In this case, the droplet size as well as the properties of the fuel jet remain the same irrespective of the engine speed. However, the fuel high-pressure realized by the pump or pumps is exploited only to a minor extent, leading to a disadvantageous energy balance. For example, in a four-cylinder four-stroke engine with a speed of 3000 revolutions per minute, the cycle period for consecutive injections is 40 ms. The duration of injection per injection period, however, maximally comes to only 2 ms, which corresponds with an energetic utilization of 5% at the most.

Proposals for technical solutions are known according to which provision is made for utilizing the water hammer principle for supplying the high-pressure wave required in one-cylinder engines for injecting the fuel into the operating cylinder. In this context, the pre-pressure required from the fuel pump is limited to a fraction of the fuel pressure needed on the respective injection nozzle. For exploiting this principle in multicylinder engines, the number of fuel pump drives, fuel pumps, as well as fuel pre-pressure lines and fuel return lines correspond to the number of engine cylinders.

In the case of cam- or camshaft-operated fuel pumps of the customary type, the drawbacks of the known solution for fuel injection substantially consist of the dependence of droplet size and spray characteristics on the engine speed. On the other hand, in the case of common rail systems, the dependence of the spray characteristics on the engine speed is avoided, but at the expense of unacceptable energetic efficiency because the high-pressure made available over the entire cycle period instead of the only-injection-duration.

If the water hammer principle, which is known for one-cylinder engines, is applied for multicylinder engines, the requirements with respect to machine and control engineering would multiply because of the required multitude of fuel pumps to be used, implicating as well the same number of fuel feed and fuel return lines to the high-pressure units. This leads to increased cost as well as to impairment of the size/performance ratio.

Therefore, it is an object of the invention to overcome the drawbacks of the known state of art. The goal is a technical solution which, with high energetic efficiency and low machine engineering expenditure, offers the possibilities for improving the size/performance ratio and the price/performance ratio in the manufacture of multicylinder engines.

SUMMARY OF THE INVENTION

According to the invention, the problem is substantially solved by a method of fuel injection in multicylinder engines in which substantially one single fuel pump conveys the fuel with pre-pressure into a pre-pressure rail, which is common to several engine cylinders. The pre-pressure corresponds to only a fraction of the required injection pressure. When the adjusted pre-pressure is exceeded, the fuel is fed from the pre-pressure common rail via pre-pressure limiting valves into the return rail, which is also common to a plurality of engine cylinders.

The pre-pressure common rail is connected to the return common rail by acceleration pipes, one pipe being provided with a shutoff valve. The fuel accelerating through a pipe when a shutoff valve is open is conveyed into the return rail, which is common to several engine cylinders. The pressure conditions in the pre-pressure common rail and in the return common rail are maintained constant with simple means, so that optimal flow conditions can be assured in any acceleration pipe over the entire speed range. In any circuit consisting of acceleration pipe and shutoff valve—between pre-pressure and return rail—at least one injection nozzle is provided. The pressure rise generated based on the water hammer effect when a shutoff valve is closed is used for the fuel injection via the respective injection nozzle.

In a preferred method, the energy of the fuel stored in the return common rail is exploited for the fuel-conveying system. The energy expenditure for supplying the fuel pre-pressure required in the pre-pressure common rail is additionally reduced.

The acceleration pipes can be connected to wave dampers as a measure to prevent undesirable impairment of the system injecting the fuel.

For generating the pre-pressure in the pre-pressure common rail, it is possible to employ a plurality of fuel pumps. The number of fuel pumps to be operated can be selected depending on the given requirements with respect to engine load.

In another embodiment of the invention, the acceleration pipe, the shutoff valve, the wave damper and the injection nozzle for every cylinder can be combined in one compact high-pressure unit per operating cylinder. If necessary, the high-pressure unit can be operated with thermal isolation by means of isolator materials and/or cooling by a cooling medium integrated in the unit.

Furthermore, it is possible to actuate the shutoff valves in the acceleration pipes of the injection system for multicylinder engines by means of solenoids.

The invention also comprises a device consisting of fuel pumps, acceleration pipes with shutoff valves, and return pipes to the fuel supply system. In the device, a pre-pressure rail common to a group of cylinders or to all cylinders of the multicylinder engine is arranged between at least one fuel pump and at least one acceleration pipe. A return rail common to a group of cylinders or to all cylinders of the multicylinder engine is arranged between the acceleration pipe and the fuel supply system. Furthermore, one or a plurality of pressure-limiting valves are arranged between the pre-pressure common rail and the return common rail.

In a special embodiment of the device, the acceleration pipe, the shutoff valve, the injection nozzle and, if need be, the wave damper corresponding to one cylinder of the engine are arranged in a common high-pressure module.

In each high-pressure module, one or several injection nozzles can be arranged between the pre-pressure rail and the return rail.

The shutoff valve and the injection nozzles of a high-pressure unit can be designed as a common structural component or in several structural components connected by lines.

Furthermore, in another embodiment of the device, there are one or several fuel pumps arranged on the pre-pressure common rail.

It is also possible to arrange one or several high-pressure modules on each operating cylinder.

In another embodiment of the device, the pre-pressure rail is designed common for a group of cylinders or for all cylinders of the multicylinder engine in the form of two chambers in one common structural unit. When the pre-pressure rail and the return rail are designed as two chambers of a common rail chamber, one or several pressure-limiting valves assuring that the pre-pressure is maintained constantly free of hysteresis and pulsation, are arranged, if need be, in the separation wall between the chambers.

It is advantageous if the high-pressure module is arranged in a thermally isolating sleeve. If necessary, such sleeve can be operated with a cooling medium. For this purpose it has a cooling medium inlet and a cooling medium outlet.

The advantages offered by the invention lie in fact that it supplies high pressure that is independent of the engine speed and not produced continually, but only during an injection event.

The invention combines the design and the control of the fuel injection system as defined by the invention with the advantageous features of a modern common rail injection system. A common pre-pressure rail for all or for individual groups of operating cylinders of a multicylinder engine, as well as the fluid control valves are operated in this connection in direct functional association with injection nozzles. A determining advantage of this system is that only about one tenth part of the required maximum pressure for injection has to be continuously generated in the pre-pressure rail, and that the maximum pressure is produced only in the form of a short-time high-pressure wave just before the fuel injection through nozzle, by controlling the respective shutoff valve at the inlet of one single injection nozzle or a group of such injection nozzles. The system is assembled for this purpose from a fuel supply system, pre-pressure module, and high-pressure modules. The required high pressure generally has to be 8 to 10 times higher than the value of pre-pressure. The technical solution as defined by the invention is practically realized in that the pre-pressure generated by a fuel pump charges a pressure accumulator that prevents pre-pressure fluctuations during fuel flow in different acceleration pipes. The accumulator is designed as a common structural component in the form of a pre-pressure rail chamber for a plurality of high-pressure modules connected with the pre-pressure rail chamber. The opening of a valve in the fuel circuit of one high-pressure module for a defined duration, provokes the fuel acceleration through the acceleration pipe of said module and the fuel return to the return rail chamber. The fuel is primarily withdrawn by the fuel pump or fuel pumps from the respective return rail chamber by exploiting the available residual pressure, whereby only the fuel mass leaving the system during the injection events is removed from the fuel tank.

Subsequently to the fuel acceleration in an acceleration pipe, by sudden closing of the valve in the respective acceleration pipe, the major part of the kinetic energy of fuel flow is converted by the fuel impact at the valve into fluid compression energy, which results in a steep pressure rise. The obtained pressure amplitude is many times higher than the static pre-pressure in the pre-pressure rail and propagates in the form of a pressure wave in the direction of the individual or several injection nozzles connected to the acceleration pipe of the respective high-pressure module, where said pressure wave can be utilized for injecting fuel.

At the end of injection, the generated pressure wave drops to the pre-pressure value, being maintained at this level by wave dampers in order to avoid undesirable secondary waves, which could impair the function of the injection system at the next injection event.

BRIEF DESCRIPTION OF THE DRAWINGS

Other objects and features of the present invention will become apparent from the following detailed description considered in connection with the accompanying drawing. It is to be understood, however, that the drawing is designed as an illustration only and not as a definition of the limits of the invention.

In the drawing.

DETAILED DESCRIPTION OF THE PREFERRED EMBODIMENT

Figure 1:
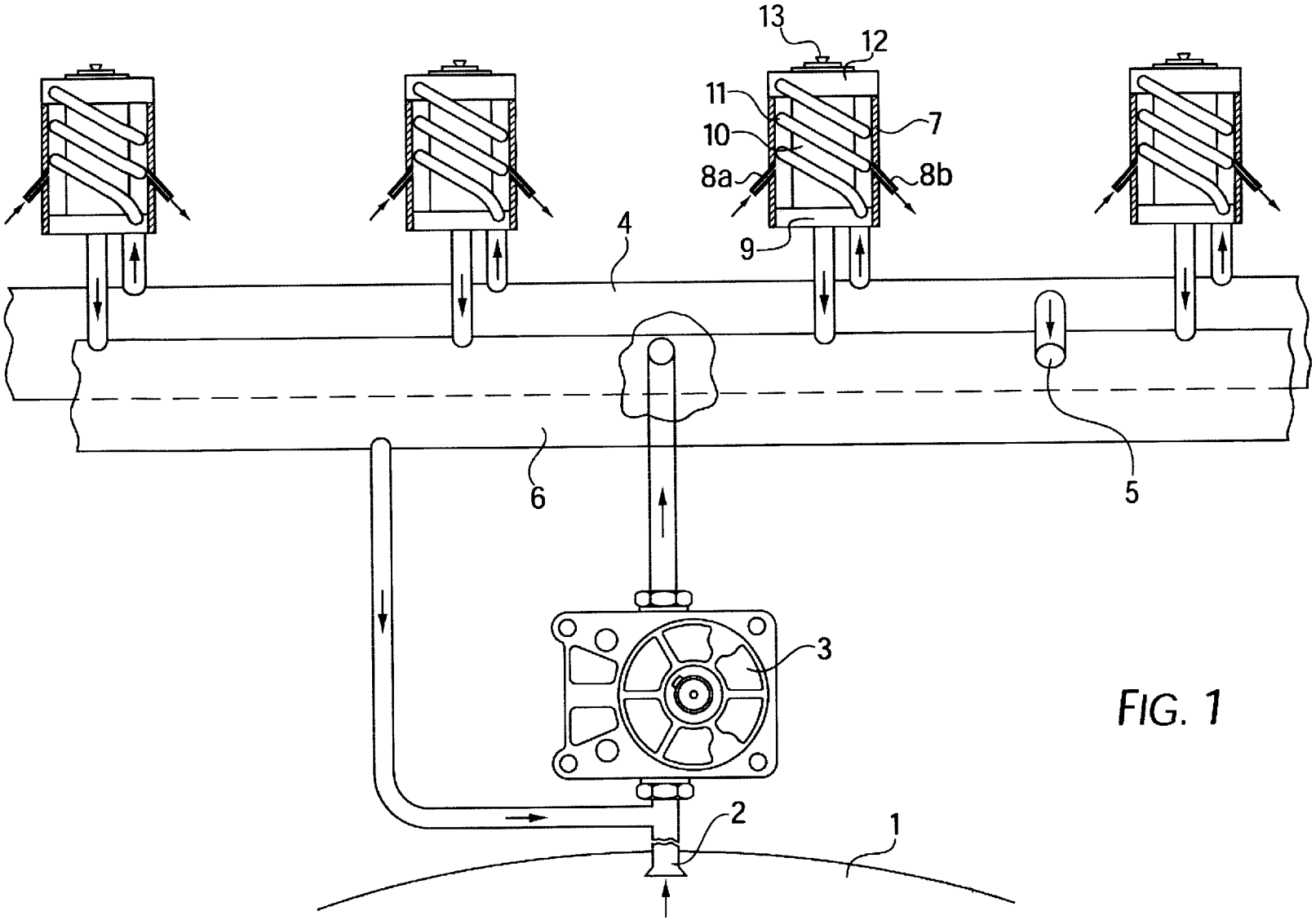
FIG. 1 is a schematic representation of a fuel injection system according to the invention for a four-cylinder engine.

FIG. 1 shows a fuel pump 3, whereby a pre-filter 2 is installed in the fuel reservoir 1. Said pre-pressure is conducted through a feed line to the pre-pressure common rail 4 which is common to all cylinders of the operating machine, and which is equipped with an additional, integrated fine fuel filter.

The pre-pressure common rail 4 feeds the high-pressure modules for the individual operating cylinders, such modules consisting of acceleration pipe 11, shutoff valve 10, wave damper 9 nozzle holder 12, and injection nozzle 13. The pre-pressure rail 4 is provided not only for fuel distribution to different high pressure modules, but at the same time—due to its dimensioning—as a pre-pressure accumulator and damper of pre-pressure fluctuations. When a shutoff valve 10 in a high-pressure module is open, the fuel is accelerated in an acceleration pipe 11 and returned to fuel pump 3 via a return rail 6, which is common to all operating cylinders, as effect of the fuel pressure difference between pre-pressure rail and return rail.

By sudden closing of the respective electromagnetically controlled shutoff valve 10 after a fuel acceleration time, the major part of the kinetic energy of the fuel flow is converted in fuel compression energy, generating a steep pressure rise. The generated pressure rise propagates in the form of a pressure wave through the acceleration pipe in both directions, to the injection nozzle 13 as well as to the wave damper 9 up to the inlet of the acceleration line 11 at the side of the pre-pressure rail. The amplitude of the pressure wave is reduced by the wave damper 9 at least to the level of the pre-pressure so as to avoid undesirable reflections. The amplitude of the pressure wave comes to about 10 times the adjusted pre-pressure on the average, determining the injection amount, utilized for injecting fuel into the respective operating cylinder via the injection nozzle 13 connected to the acceleration pipe 11.

A short-circuit line is arranged between pre-pressure rail 4 and return rail 6, and is being equipped with a pressure-limiting valve 5 for keeping the pre-pressure constant with low pulsation. The fuel excess pressure available in the return rail 6 is directly supplied on fuel pump 3 to the pre-pressure system. A thermal isolator 7 is arranged around the high-pressure module for thermal protection and noise damping. Cooling liquid flows through the isolator 7 via a cooling medium inlet 8*a* and a cooling medium outlet 8*b*.

Accordingly, while only one embodiment of the present invention have been shown and described, it is obvious that many changes and modifications may be made thereunto without departing from the spirit and scope of the invention.

What is claimed is:

1. A method of injecting fuel in multicylinder engines, comprising:

generating a fuel pre-pressure to be converted within acceleration pipes by opening controlled shutoff valves and recirculating fuel to a fuel pump inlet;

conveying the fuel under pre-pressure via a fuel pump into a pre-pressure common rail common to several engine cylinders, wherein the pre-pressure is only a fraction of the required injection pressure;

feeding the fuel, when the pre-pressure is exceeded, from the pre-pressure common rail via pressure-limiting valves into a return common rail common to several engine cylinders when the shutoff valve is open; and shutting off the shutoff valves, provoking a steep rise of fuel pressure due to a water hammer effect, so that a high-pressure wave produced when a shutoff valve closes supplies high pressure for fuel injection through an injection nozzle associated with the shutoff valve, wherein for every shutoff valve one acceleration pipe is used between the pre-pressure common rail and the return common rail, and wherein at least one injection nozzle is actuated in the respective acceleration pipe per shutoff valve.

2. The method according to claim 1, wherein energy of the fuel stored in the return common rail is used to convey the fuel.

3. The method according to claim 1, wherein the acceleration pipe is operated with wave dampers.

4. The method according to claim 1, wherein several fuel pumps are used for producing the pre-pressure in the pre-pressure common rail.

5. The method according to claim 4, wherein the number of fuel pumps to be operated is selected in accordance with the engine load requirements.

6. The method according to claim 3, wherein the acceleration pipe, the shutoff valve, the wave damper and the injection nozzle are combined in one high-pressure unit.

7. The method according to claim 6, wherein the high-pressure unit is operated thermally isolated versus the engine via a thermal isolator and is cooled by a cooling medium.

8. The method according to claim 1, wherein the shutoff valve is operated electromagnetically.

9. The method according to claims 1, wherein the shutoff valve is operated mechanically.

* * * * *